United States Patent [19]

Marcello

[11] 4,248,273

[45] Feb. 3, 1981

[54] STIRRUP MACHINE

[76] Inventor: Del F. Marcello, Via Chisimaio, 43/7 - 33100 Udine, Italy

[21] Appl. No.: 49,248

[22] Filed: Jun. 18, 1979

[30] Foreign Application Priority Data

Feb. 28, 1979 [IT] Italy ..... 83341 A/79

[51] Int. Cl.[3] ..... B21F 1/00

[52] U.S. Cl. ..... 140/105; 72/217

[58] Field of Search ..... 140/105, 102; 72/217, 72/219, 203

[56] References Cited

U.S. PATENT DOCUMENTS

| | | | |
|---|---|---|---|
| 3,823,749 | 7/1974 | Ritter et al. | 140/105 |
| 3,991,600 | 11/1976 | Del Fabro | 72/203 |
| 4,049,026 | 9/1977 | Del Fabro | 140/105 |

*Primary Examiner*—Richard B. Lazarus

*Attorney, Agent, or Firm*—Nilsson, Robbins, Dalgarn, Berlinger, Carson & Wurst

[57] ABSTRACT

A stirrup machine for bending metallic stock material such as bars, wire, strips and the like and forming individual bent pieces therefrom including: advancing and reversing and other suitable apparatus (1) for selectively advancing and reversing the feed of the stock material (2) and to retract the finished bent product; shear and guide apparatus (3) for the stock material (2); bending apparatus (4) having an interchangeable fixed central bending fork (7) to guide and support the stock material (2) and a bending pin (8) for bending the stock material (2) around the central fork (7) in a clockwise or counterclockwise direction. The invention is characterized in that the stock guide apparatus (5) is tranversally movable forward and backward to push the stock material (2) out of the bending plane, to disengage it from the bending apparatus (4) or to recall the stock material to re-engage it with the respective bending apparatus (4) and to shear it in connection with a countershear (6) after the stock material (2) has completed a stirrup.

3 Claims, 25 Drawing Figures

STIRRUP MACHINE

FIELD OF THE INVENTION

This invention is related to a stirrup machine or a bending machine for metallic stock material such as bars, wire, strips or the like.

BACKGROUND OF THE INVENTION

Semi-automatic or automatic stirrup machines or bending machines which work by continuous feeding are already known in the prior art. Bending and stirrup machines which bend bars, wire or the like in any shape by bending either clockwise or counterclockwise have also been developed.

It has been particularly noticed that a wellknown type of stirrup machine utilizes a bending method based on a bending unit with a fixed fork around which a bending pin is made to partially rotate clockwise or counterclockwise making it re-enter and pass either above or under the bending bar. The expulsion of the finished product is caused by a central pin which is coaxial to the rotation axis of said bending pin.

In other cases, this pin acts not only as an expeller, but also as shearing element. These first types of machines are at a very advanced basis, but they are very complicated and expensive because they require a large number of moveable parts. In other cases, said central pin is eliminated and the fork is movable axially effacing in order to allow the expulsion of the finished product in connection with a shearing unit (U.S. Pat. Nos. 3,991,600, issued Nov. 16, 1976, and 4,049,026, issued Sept. 20, 1977.

SUMMARY OF THE INVENTION

It is accordingly an object of the present invention to overcome the disadvantages of the prior art as mentioned above.

Furthermore, in order to simplify the stirrup machine and to reduce its production costs, the invention incorporates a bending unit with a central fork and a bending pin which is non-movable axially. The fork is also non-rotatable so as to avoid the dragging of the bar during the bending phase.

A guide unit for said stock material to be bent is placed upstream of said bending unit, said guide unit being movable transversally in a forward and backward direction for pushing said stock material out of the bending plane to disengage said bending unit in order to allow the reversing of said bending rotation of said bending pin by positioning it under said stock material on the opposite side for the reversed bending, and reversal of the feed to recall the bent material before the shearing to reduce waste.

In a preferred embodiment of the invention, the shear guide unit comprises a movable shear guide and a fixed interchangeable countershear which cooperate to shear the stock material when said shear guide moves in completely backward beyond said countershear.

BRIEF DESCRIPTION OF THE DRAWINGS

The preferred embodiment of the invention will be better explained in conjunction with the following drawings in which.

DETAILED DESCRIPTION OF THE PREFERRED EMBODIMENT

Figure 1:
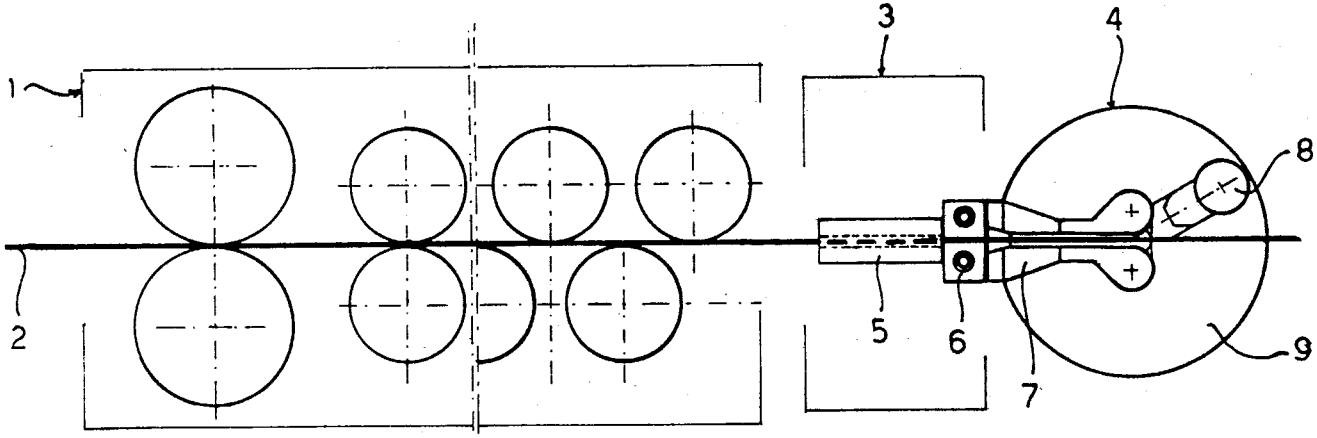
FIG. 1 is a schematic frontal view of the operating unit of the machine adjacent to the partially seen bending and shear guide unit.
Figure 2:
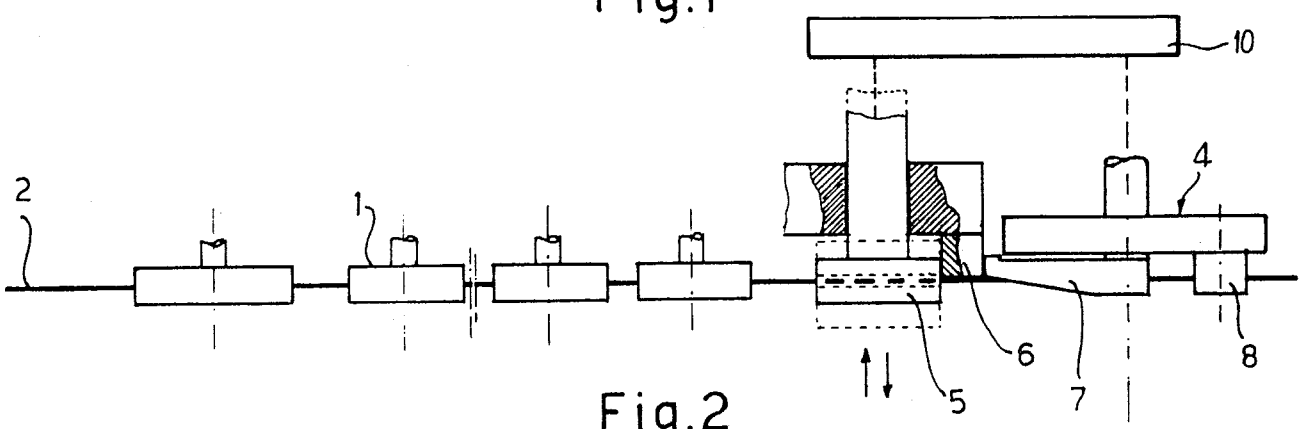
FIG. 2 is a schematic top view of the operating unit of FIG. 1.

According to FIGS. 1–2, the stirrup machine consists of a well-known feeder-retractor unit 1 for the stock material 2; a shear guide unit 3 for the stock material 2; a bending unit 4 for the stock material 2; a conventional electronically programmable control means 10 to drive the above-mentioned units, not illustrated and well-known in the field.

The shear guide unit 3 consists of an interchangeable transversally movable shear guide 5 and a fixed interchangeable countershear 6, placed adjacent to the stock material 2 between said shear guide 5 and said bending unit 4. The stock material 2 is sheared by moving the shear guide 5, and hence the stock material 2 toward the fixed countershear 6. The relative movement of the end of the shear guide 5 against the end of the countershear 6 shears off the stock material 2 protruding from the end of the shear guide 5.

The shear guide 5 is shaped as a piece of pipe to guide and advance within it said stock material 2.

The bending unit 4 consists of a fixed interchangeable central fork 7 and a rotatable bending pin 8, mounted on a rotatable bending disc 9 positioned adjacent to said central fork 7.

Figure 3:
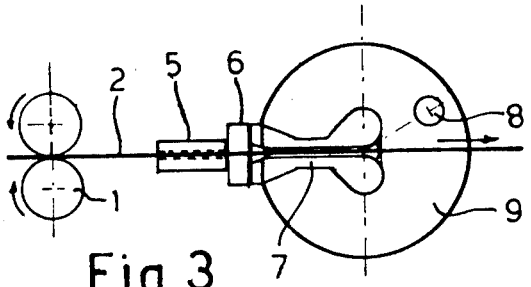
FIGS. 3 to 25 are a series of exemplifying operative phases which illustrate the operating system of said unit (and consequently the stirrup machine).
Figure 4:
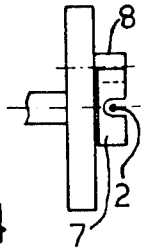
Figure 5:
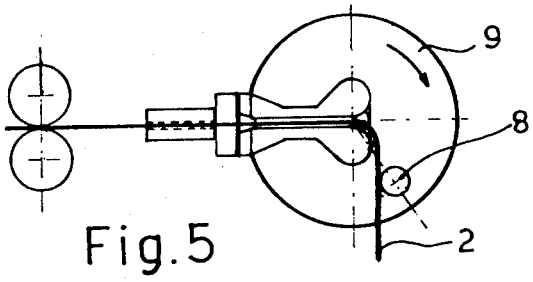
Figure 6:
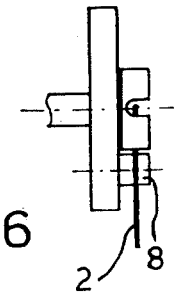
Figure 7:
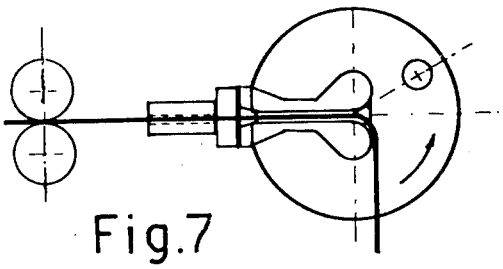
Figure 8:
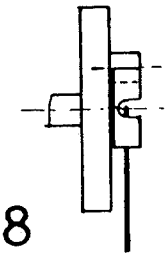
Figure 9:
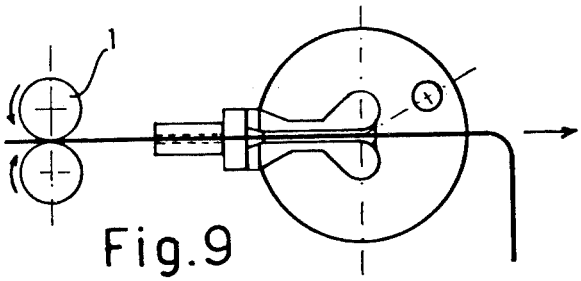
Figure 10:
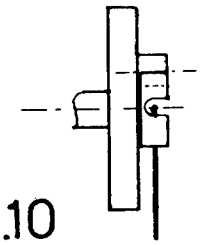
Figure 11:
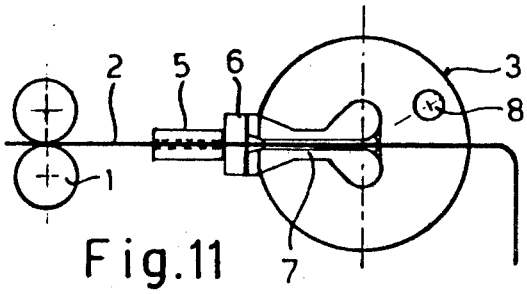
Figure 12:
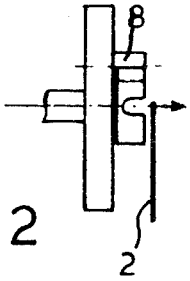
Figure 13:
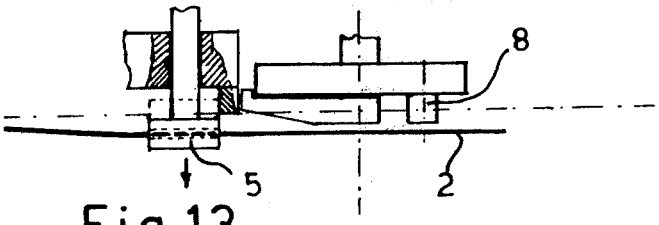
Figure 14:
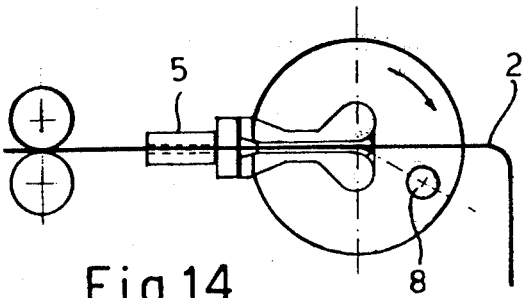
Figure 15:
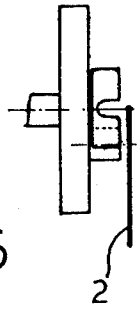
Figure 16:
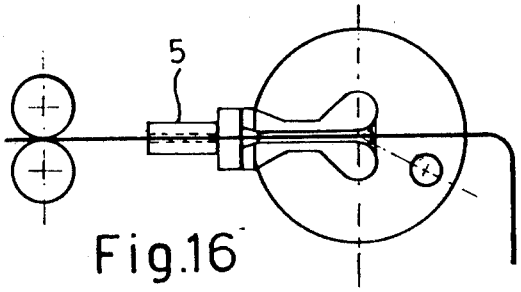
Figure 17:
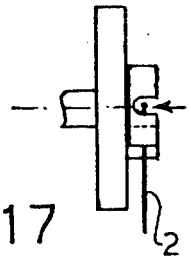
Figure 18:
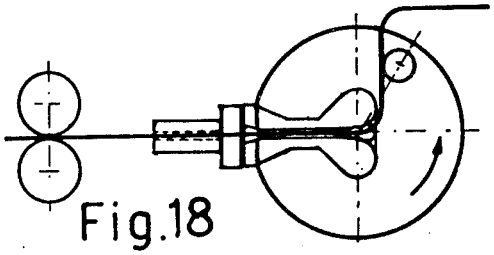
Figure 19:
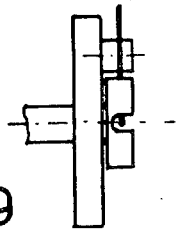
Figure 20:
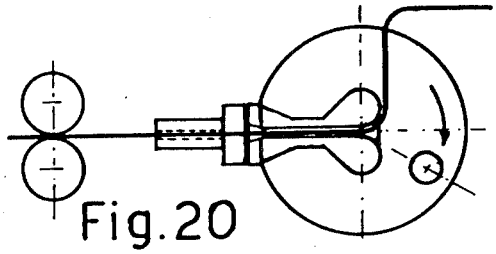
Figure 21:
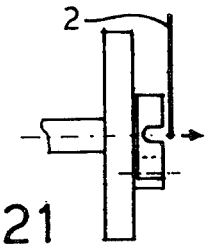
Figure 22:
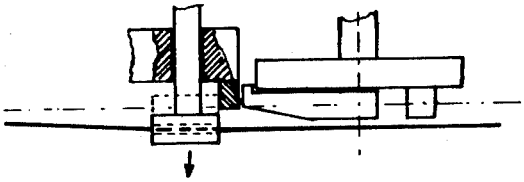
Figure 23:
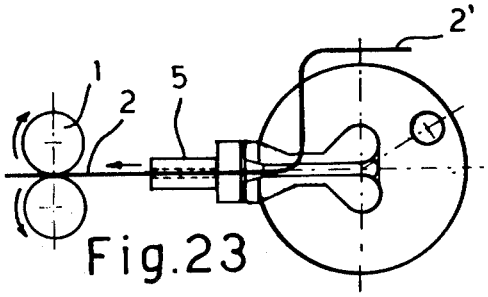
Figure 24:
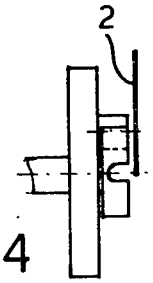
Figure 25:
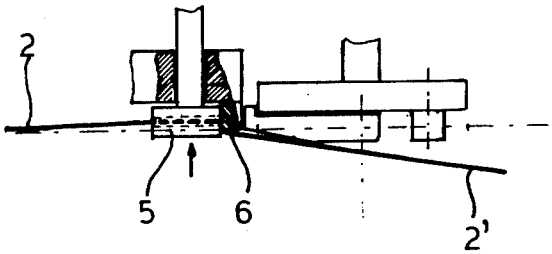

Referring to one of the possible methods for preparing stirrups, the operating units work as follows:

1. The feeder-retractor 1 causes the stock material 2 to proceed forward to a desired extent in a conventional manner, such as with an electronic system of counter-pulses. This allows the stock material 2 to pass through the shear guide 5, adjacent the fixed countershear 6 and through the fork 7 (FIGS. 3–4).
2. The bending disc 9 with the bending pin 8, which is in position on one side of the stock material 2, will initiate a first bending of the stock material 2 by rotating, for instance, in a clockwise direction against the stock material as shown in FIGS. 5–6.
3. After this, the disc 9 and the bending pin 8 return to their original position (FIGS. 7–8), while a predetermined length of the stock (2) is moved through the machine (FIGS. 9–10).
4. The shearing unit 5 then shifts forward to push the stock material 2 out of the bending plane of the bending pin 8 (FIGS. 11, 12, 13). The disc 9, and hence the bending pin 8, is then rotated to the opposite side with respect to the stock material 2 by means of a clockwise rotation (FIGS. 14, 15).
5. The shear guide 5 next pulls the stock material back to the normal position in the bending plane of the bending pin 8 (FIGS. 16, 17), and another bending is performed by rotating the disc 9, and hence the pin 8, counterclockwise (FIGS. 18, 19).
6. When the stirrup is completed, the shear guide 5 shifts forward pushing the stock material 2 out of the bending plane (FIGS. 20, 21, 22).
7. The bent stock material 2 is then withdrawn by means of the feeder-retractor unit 1 (FIGS. 23, 24).
8. The shear guide 5 is then retracted toward and beyond the edge of the fixed countershear 6 and the stirrup is cut-off from the stock material 2 at the desired point (FIG. 25).

Obviously, the invention is not limited to the above-described and illustrated embodiments; on the contrary, they can be considered as the base of other forms and ways of realization whose executing details may vary without exceeding the essence of the stated and hereindescribed disclosure.

It will be obvious to those skilled in the art that various changes may be made without departing from the scope of the invention and the invention is not to be considered to be limited to what is shown in the drawings and described in the specification.

What is claimed:

1. A stirrup machine for bending stock material such as bars, wire, strips or the like comprising:

advancing and reversing means for selectively advancing and reversing the feed of the stock material;

bending means comprising a fixed, dual prong central fork having an exit end, the stock material being positioned between the two prongs and extending out through the exit end for guiding and supporting the stock material in a bending plane, and a bending pin rotatable in the bending plane about the exit end of the central fork for bending the stock material extending therefrom, around the central fork in a clockwise or counterclockwise direction;

shear and guide means positioned between the advancing and reversing means and the bending means for guiding the stock material in a direction transverse to the direction of stock material feed, for disengaging the stock material from the bending means and displacing the stock material out of the bending plane and for retracting the stock material into the bending plane between the dual prongs of the bending means.

2. A stirrup machine according to claim 1, wherein said stock shear and guide means comprises:

a transversally movable shear guide for pushing said stock material out of the bending plane to disengage said stock material from said bending means and for recalling said stock material in a partial recalling movement to a bending position for reengaging said stock material with said bending means; and a fixed countershear positioned adjacent the end of the movable shear guide between said movable shear guide and said bending means, said stock material being sheared by said countershear as the recall movement continues beyond said bending position.

3. A stirrup machine according to claims 1 or 2 further comprising a programmable control means coupled for controlling the advancing and reversing means to selectively and intermittently advance and retract the feed of the stock material through the machine; for controlling the shear and guide means to selectively and intermittently move the stock material transverse to the direction of stock feed for moving the stock into and out of the bending plane and for moving the stock against the fixed countershear to shear the stock material; and for controlling the bending means for selectively and intermittently rotating the bending pin against the stock material in a clockwise or counterclockwise direction.

* * * * *